US007078866B2

(12) United States Patent
Choi

(10) Patent No.: US 7,078,866 B2
(45) Date of Patent: Jul. 18, 2006

(54) PLASMA DISPLAY PANEL AND METHOD FOR DRIVING THE SAME

(75) Inventor: Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 63 days.

(21) Appl. No.: 10/889,177

(22) Filed: Jul. 13, 2004

(65) Prior Publication Data

US 2005/0012690 A1 Jan. 20, 2005

(30) Foreign Application Priority Data

Jul. 15, 2003 (KR) ..... 10-2003-0048185

(51) Int. Cl.
*G09G 3/10* (2006.01)

(52) U.S. Cl. ..... 315/169.4; 315/169.3

(58) Field of Classification Search ..... 315/168, 315/169.1–169.4; 345/60–63
See application file for complete search history.

(56) References Cited

U.S. PATENT DOCUMENTS 4,866,349 A * 9/1989 Weber et al. ..... 315/169.4
5,081,400 A * 1/1992 Weber et al. ..... 315/169.4
6,646,387 B1 * 11/2003 Chae et al. ..... 315/165
2003/0193454 A1 * 10/2003 Lee et al. ..... 345/63
2004/0046756 A1 * 3/2004 Kim et al. ..... 345/204
2005/0029960 A1 * 2/2005 Roh et al. ..... 315/169.4
2005/0073483 A1 * 4/2005 Lee et al. ..... 345/63

* cited by examiner

*Primary Examiner*—Tuyet Vo
*Assistant Examiner*—Marie Antoinette Cabucos
(74) *Attorney, Agent, or Firm*—Fleshner & Kim LLP

(57) ABSTRACT

An energy recovery circuit of a plasma display panel and a drive method thereof are disclosed. A plasma display panel according to the present invention comprises an inductor for charging or discharging the panel capacitor, inductor charge path means which provides a path through which energy is charged to the inductor, panel capacitor charge path means which provides a path through which the panel capacitor is charged with the energy charged in the inductor, panel capacitor discharge path means which provides a path through which the panel capacitor is discharged, auxiliary storage means which stores energy if the substantially fully discharged state of the panel capacitor is maintained and supplies the energy to the panel capacitor if the substantially fully charged state of the panel capacitor is maintained, and potential sustain means connected to the inductor and the panel capacitor, wherein the potential sustain means includes switch means connected between the auxiliary storage means and the panel capacitor and another switch means connected between a ground potential and the panel capacitor.

17 Claims, 5 Drawing Sheets

PLASMA DISPLAY PANEL AND METHOD FOR DRIVING THE SAME

TECHNICAL FIELD

The present invention relates to a plasma display panel (hereinafter, referred to as "PDP"). More particularly, the present invention relates to plasma display panel and method for driving the same in which the energy recovery circuit uses a booster drive circuit that is able to reduce a sustain voltage by half to thereby reduce the amount of energy consumed by a drive circuit of the PDP and reduce a rise time of a sustain pulse.

BACKGROUND OF THE INVENTION

The biggest drawback of the PDP is its large consumption of power. In order to reduce the amount of power consumed by the PDP, it is necessary to enhance its illumination efficiency and to minimize the unnecessary use of power (not directly related to discharge) that occurs during the drive process.

The AC PDP utilizes surface discharge occurring on a surface of a dielectric substance that is deposited on electrodes. In the AC PDP, in order to perform sustain discharge of tens of thousands to several millions of cells, a drive pulse has a few tens of volts to a few hundred volts [V], and its frequency is a few hundred kilohertz [kHz] and higher. If such a drive pulse, is applied to within the cells, charge/discharge of a high electric capacity occurs.

When charge/discharge occurs in this manner in the PDP, although there is no energy consumption by only the capacity load of the panel, there is significant energy loss in the PDP since the drive pulse is generated using DC power. In particular, if an excessive current flows in the cells during discharge, an even greater energy loss occurs. This energy loss causes an increase in the temperature of switch elements, and, in the worst case, the switch elements may be destroyed by such a temperature increase. An energy recovery circuit is included in a drive circuit of the PDP to recover the energy unnecessarily generated in the panel.

FIG. 1 is a circuit diagram of a conventional energy recovery circuit. With reference to FIG. 1, an energy recovery circuit disclosed by Weber (U.S. Pat. No. 5,081,400) includes first and second switches SW1 and SW2 connected in parallel between an external capacitor Css and inductor L, a third switch SW3 for supplying a sustain voltage Vs to a panel capacitor Cp, and a fourth switch SW4 for supplying a ground voltage GND to the panel capacitor Cp.

First and second diodes D1 and D2 are connected in series between the first and second switches SW1 and SW2, and act to prevent the flow of reverse current. The panel capacitor Cp equivalently exhibits the value of electrostatic capacity of the panel. Semiconductor switch devices are used for the switches SW1, SW2, SW3, and SW4. For example, MOSFETs (metal oxide semiconductor field effect transistors) may be used for the switches SW1, SW2, SW3, and SW4.

FIG. 2 shows timing diagrams of the switches SW1, SW2, SW3, and SW4, and graphs of a voltage Vp applied to one end of the panel capacitor Cp and of a current IL flowing through the inductor L during charge/discharge. The capacitor Cp, the inductor L, and the switches SW1, SW2, SW3, and SW4 are those appearing in the energy recovery circuit of FIG. 1.

If it is assumed that a voltage equal to one half the sustain voltage Vs (i.e., Vs/2) is charged to the external capacitor Css, the energy recovery circuit of FIG. 1 may be described in connection with FIG. 2 as follows.

During an interval T1, if the first switch SW1 is turned on and the second, third, and fourth switches SW2, SW3, and SW4 turned off, a voltage stored in the external capacitor Css passes through the first switch SW1 and the first diode D1 to be supplied to the inductor L. As a result, the inductor L and the panel capacitor Cp form an LC series resonance circuit such that the panel capacitor Cp is charged with a voltage by a resonance waveform. The voltage charged to the panel capacitor Cp is increased until reaching the sustain voltage Vs. A positive resonance current IL flowing through the inductor L increases from 0 to a predetermined level according to the increase in voltage, then again is reduced to 0.

During an interval T2, if the first switch SW1 is turned off, the third switch SW3 turned on, and the second and fourth switches SW2 and SW4 left in their off states, the sustain voltage (Vcc=Vs) passes through the third switch SW3 to be supplied to the panel capacitor Cp. The voltage applied to one end of the panel capacitor Cp maintains the sustain voltage.

During an interval T3, if the third switch SW3 is turned off, the second switch SW2 turned on, and the first and fourth switches SW1 and SW4 left in their off states, the voltage charged in the panel capacitor Cp passes through the inductor L, the second diode D2, and the second switch SW2 such that the energy is recovered by the external capacitor Css. The voltage applied to one end of the panel capacitor Cp at this time is reduced from the sustain voltage Vs to 0. Further, a negative resonance current IL flowing through the inductor L increases starting from 0 until reaching a predetermined level, then again drops to 0 according to the reduction in voltage.

In an interval T4, if the second switch SW2 is turned of, the fourth switch SW4 turned on, and the first and third switches SW1 and SW3 left in their off states, the panel capacitor Cp maintains a ground voltage GND.

In the conventional energy recovery circuit described above, since the panel capacitor is charged by natural LC resonance, the amount of time it takes to charge the panel capacitor is increased. Further, since a relatively large sustain voltage is supplied to the panel capacitor, power consumption is increased.

SUMMARY OF THE INVENTION

Therefore, the present invention has been made in view of the above problems, and it is an object of the present invention to provide an energy recovery circuit of a PDP and a drive method thereof in which a sustain voltage used in the conventional energy recovery circuit is reduced by one half such that the amount of power consumed by a drive circuit is reduced, and in which a booster drive circuit is used during charging of a panel capacitor to thereby minimize a rise time of a sustain pulse is minimized.

According to the present invention, a plasma display panel includes sustain means for providing energy to electrodes related to selected cells to effect discharge in the selected cells, and a panel capacitor, wherein the sustain means comprises: an inductor for charging or discharging the panel capacitor; inductor charge path means which provides a path through which energy is charged to the inductor and is opened when the inductor is substantially fully charged; panel capacitor charge path means which provides a path through which the panel capacitor is charged with the energy charged in the inductor and is opened when the panel capacitor is substantially fully charged; panel capacitor discharges path means which provides a path through which the panel capacitor is discharged and is opened when the panel capacitor is substantially fully discharged; and auxiliary storage means which stores energy if the substantially fully discharged state, of the panel capacitor is maintained and supplies the energy to the panel capacitor if the substantially fully charged state of the panel capacitor is maintained.

According to the present invention, a plasma display panel includes an energy recovery circuit which is connected to each scan electrode and sustain electrode, and supplies a sustain pulse having a sustain voltage alternately to a panel capacitor that is formed equivalently in the discharge cell of the panel, wherein the energy recovery circuit comprises: an external ½ sustain voltage source having a voltage that is one half of the sustain voltage; an external capacitor for recovering energy when energy stored in the panel capacitor is discharged; an inductor for charging or discharging the panel capacitor; a multiple voltage circuit including an auxiliary capacitor for generating the sustain voltage using the voltage of the ½ sustain voltage source; a first switch turned on a first time such that energy is charged to an inductor, and turned on a second time such that the sustain voltage is supplied to the panel capacitor; a second switch turned on at the same time the first switch is turned on for the second time such that the sustain voltage is supplied to the panel capacitor; a third switch turned on such that energy stored in the panel capacitor is discharged to the external capacitor; and a fourth switch turned on such that a ground voltage is supplied to the panel capacitor and a ½ sustain voltage is charged to the auxiliary capacitor in the multiple voltage circuit.

According to the present invention, a method for driving a plasma display panel in which the plasma display panel is driven through an inductor connected to panel electrodes in the plasma display panel having a panel capacitor corresponding to the panel electrodes, the method comprises: charging the panel capacitor through the inductor in which the charging of the panel capacitor starts when an inductor current is at a maximum, and is discontinued when the inductor current becomes zero; and discharging the panel capacitor through the inductor firstly while energy is stored in the inductor until the inductor current reaches a maximum, and secondly while energy stored in the inductor is removed until the inductor current reaches zero.

DETAILED DESCRIPTION

Preferred embodiment of the present invention will be described in a more detailed manner with reference to the drawings.

Figure 1:
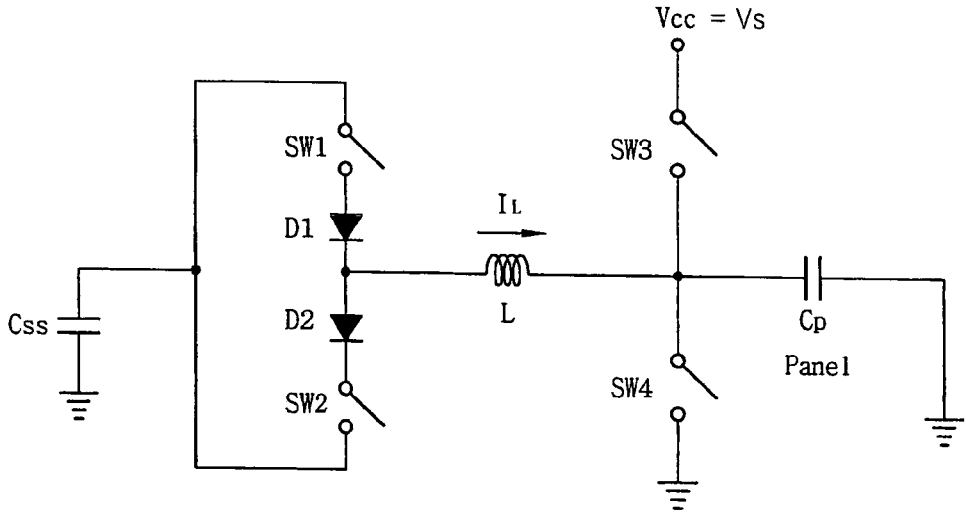
Fig. 1 Prior Art
FIG. 1 is a circuit diagram of a conventional energy recovery circuit.
Figure 2:
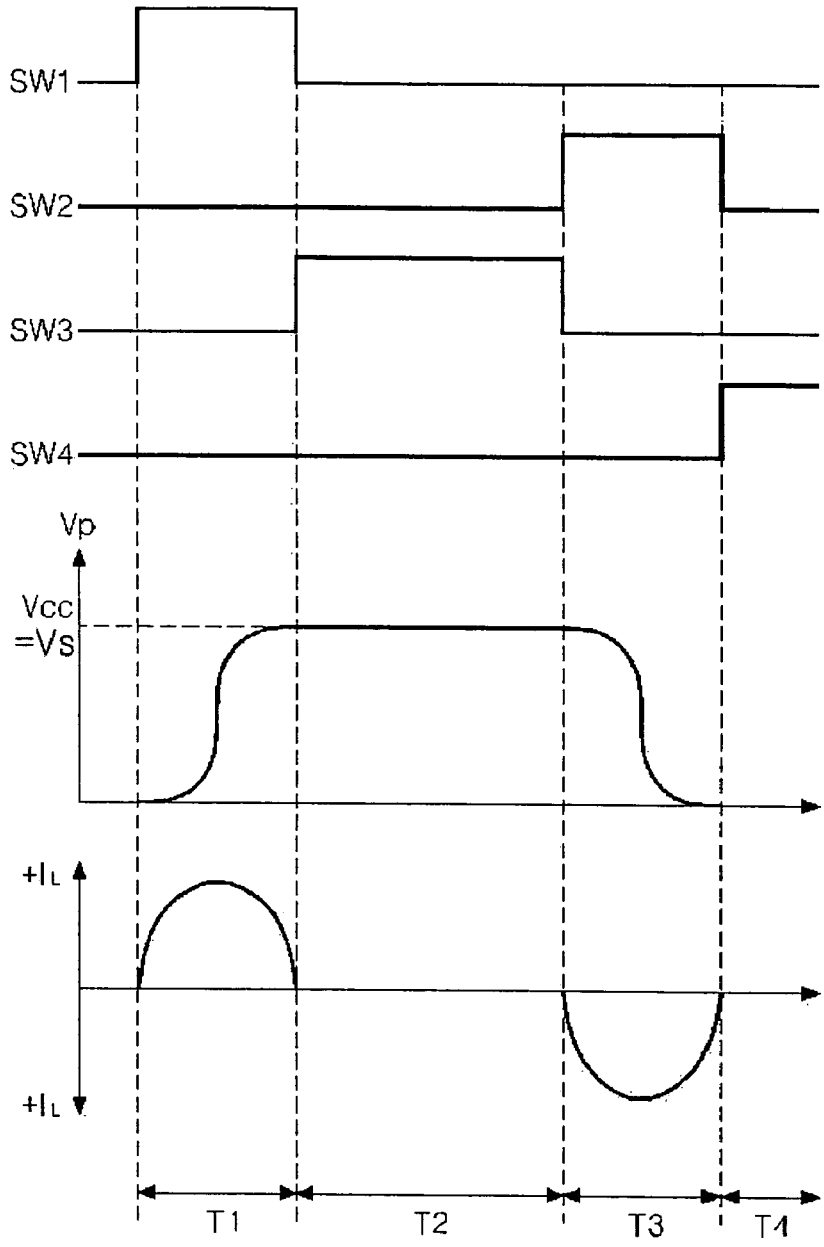
Fig. 2 Prior Art
FIG. 2 shows timing diagrams of switches in the energy recovery circuit of FIG. 1 and drive waveforms of the energy recovery circuit.
Figure 3:
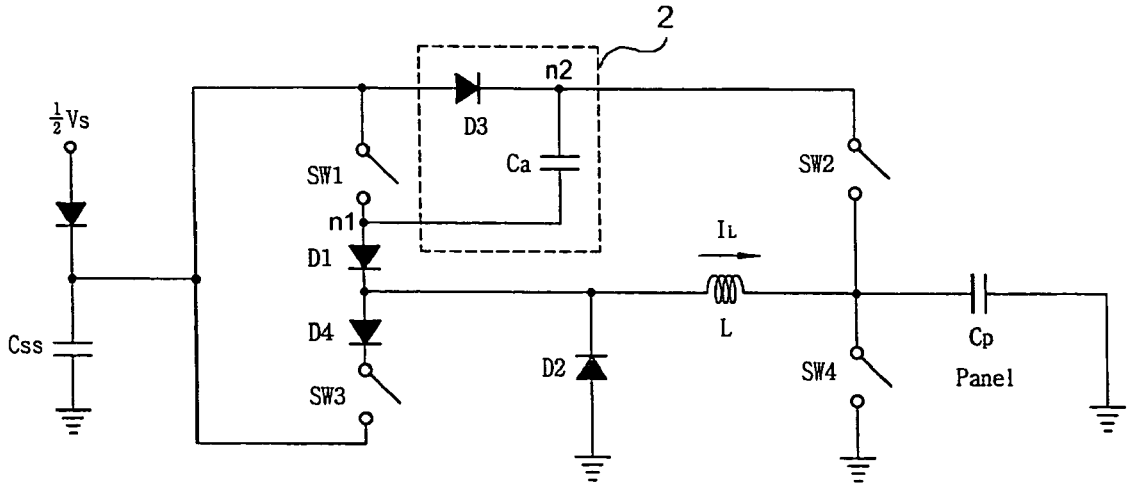
FIG. 3 is a circuit diagram of an energy recovery circuit according to the present invention.

FIG. 3 is a circuit diagram of an energy recovery circuit according to the present invention. With reference to FIG. 3, the energy recovery circuit of the present invention includes an external ½ sustain voltage source having a voltage that is one half of a sustain voltage, an external capacitor for recovering energy when energy stored in a panel capacitor is discharged, an inductor for charging and discharging the panel capacitor, a multiple voltage circuit including an auxiliary capacitor for generating the sustain voltage using the voltage of the ½ sustain voltage source, a first switch that is turned on a first time such that energy is charged to the inductor and turned on a second time such that the sustain voltage is supplied to the panel capacitor, a second switch that is turned on at the same time the first switch is turned on for the second title such that the sustain voltage is supplied to the panel capacitor, a third switch that is turned on such that energy stored in the panel capacitor is discharged to the external capacitor, and a fourth switch that is turned on such that a ground voltage is supplied to the panel capacitor and a ½ sustain voltage is charged to the auxiliary capacitor in the multiple voltage circuit.

The multiple voltage circuit 2 includes the auxiliary capacitor Ca for charging the ½ sustain voltage Vs/2, and a third diode D3 for preventing the flow of reverse current and that is mounted between one end of the auxiliary capacitor Ca, the ½ sustain voltage source, and the first switch SW1.

First and fourth diodes D1 and D4 for preventing the flow of reverse current are connected in series between the first and third switches SW1 and SW3. Further, a second diode D2 is connected in series between an inductor L and a ground voltage source GND to form a current path through which energy stored in the inductor L is supplied to the panel capacitor.

The panel capacitor Cp equivalently exhibits the value of electrostatic capacity of the panel. The switches SW1, SW2, SW3, and SW4 are semiconductor switch devices such as MOSFETs.

Figure 4:
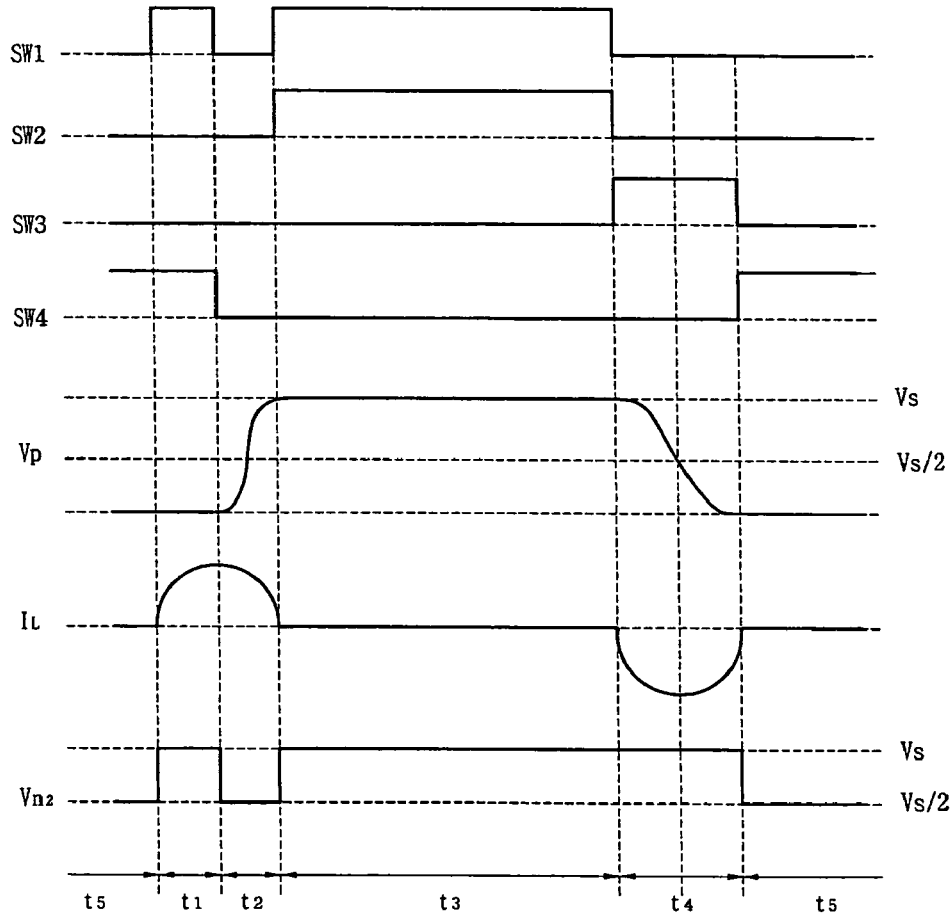
FIG. 4 shows timing diagrams of switches in the energy recovery circuit of FIG. 3 and drive waveforms of the energy recovery circuit.

FIG. 4 shows timing diagrams of the switches SW1, SW2, SW3, and SW4 in the energy recovery circuit of FIG. 3, and waveforms during charging and discharging of a voltage Vp applied to the panel capacitor Cp a current IL flowing to the inductor L, and a voltage Vn2 applied to a node n2. An operation of the energy recovery circuit of FIG. 3 may be described in connection with FIG. 4 as follows.

Figure 5:
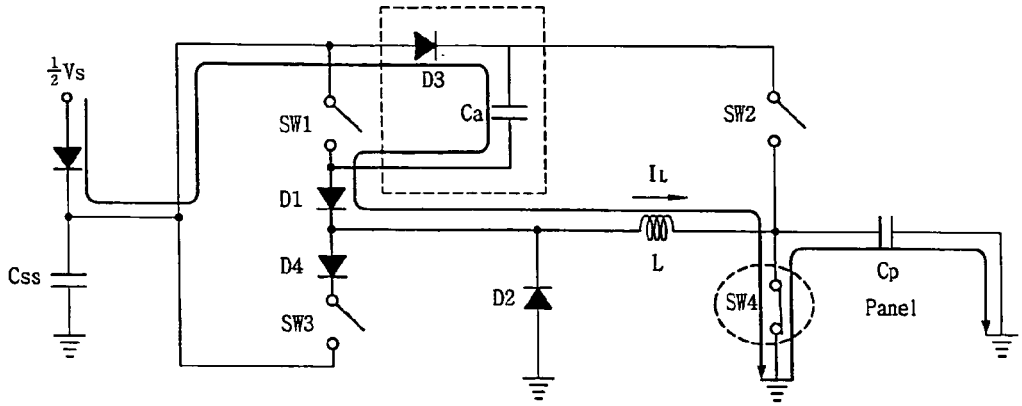
FIG. 5 is a circuit diagram of the energy recovery circuit of FIG. 3 during operation in an interval t5.

FIG. 5 is a circuit diagram of the energy recovery circuit of FIG. 3 during operation in an interval t5 of FIG. 4 During the interval t5, the fourth switch SW4 is turned on while the first, second, and third switches SW1, SW2, and SW3 are turned off. With the switches set in this manner, two closed loops as shown in FIG. 5 are formed. The first closed loop is formed passing through (in this sequence) the ½ sustain voltage source Vs/2, the third diode D3, the auxiliary capacitor Ca, the first diode D1, the inductor L, the fourth switch SW4, and the ground voltage source GND. The second closed loop is formed passing through (in this sequence) the ground voltage source GND, the fourth switch SW4, and again back to the ground voltage source GND. The auxiliary capacitor Ca in the first closed loop is charged with the ½ sustain voltage Vs/2 by the ½ sustain voltage source Vs/2, and the panel capacitor Cp in the second loop maintains the ground voltage GND by the ground voltage source GND).

Figure 6:
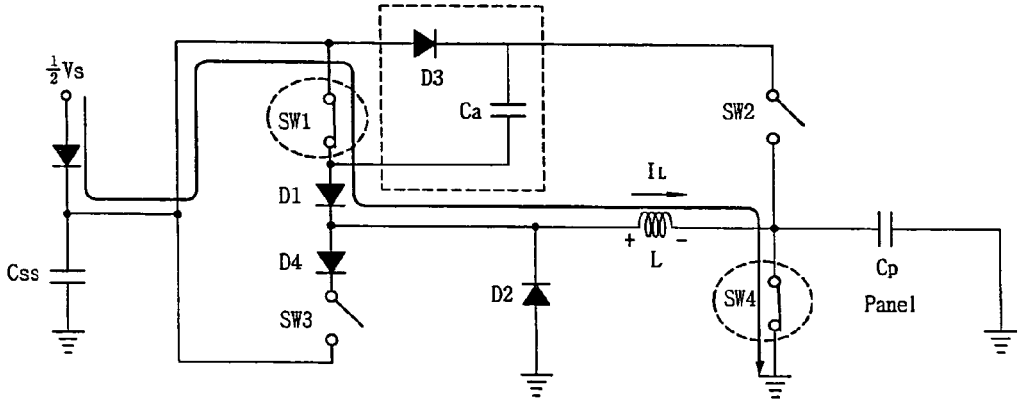
FIG. 6 is a circuit diagram of the energy recovery circuit of FIG. 3 during operation in an interval t1.

FIG. 6 is a circuit diagram o the energy recovery circuit of FIG. 3 during operation in an interval t1 of FIG. 4. During the interval t1, the fourth switch SW4 is maintained in an on state, the first switch is turned on, and the second and third switches SW2 and SW3 are maintained in off states. With these switches set in this manner, a closed loop is formed as shown in FIG. 6 passing through (in this sequence) the ½ sustain voltage source Vs/2, the first switch SW1, the first diode D1, the inductor L, the fourth switch SW4, arid the ground voltage source GND. Energy is stored in the inductor L by the ½ sustain voltage source Vs/2. Also, the interval t1 is continued until the current IL flowing through the inductor L reaches a maximum.

Figure 7:
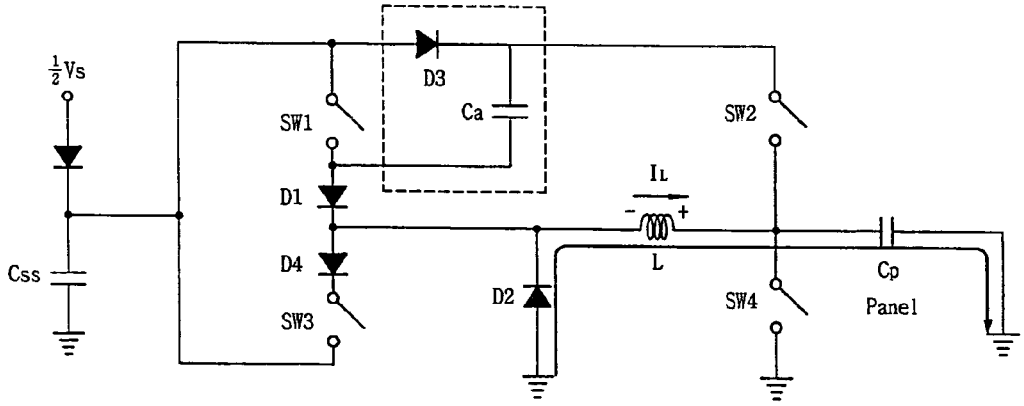
FIG. 7 is a circuit diagram of the energy recovery circuit of FIG. 3 during operation in an interval t2.

FIG. 7 is a circuit diagram of the energy recovery circuit of FIG. 3 during operation in an interval t2 of FIG. 4 During the interval t2, the first, second, third, and fourth switches SW1, SW2, SW3, and SW4 are all either turned off or maintained in their off states. If the first, second, third, and fourth switches SW1, SW2, SW3, and SW4 are all in an off state, a reverse voltage is leaved in the inductor L as shown in FIG. 7. Since with this operation of the switches SW1, SW2, SW3, and SW4 a closed loop is formed passing through (in this sequence) the second diode D2, the inductor L, the panel capacitor Cp, then to the ground voltage source GND, the reverse voltage leaved in the inductor L is supplied to the panel capacitor Cp. The panel capacitor Cp is quickly charged (boosted-up) by the reverse voltage of the inductor L. At this time, the second diode D2 acts in this closed loop as a current path of the inductor L.

Figure 8:
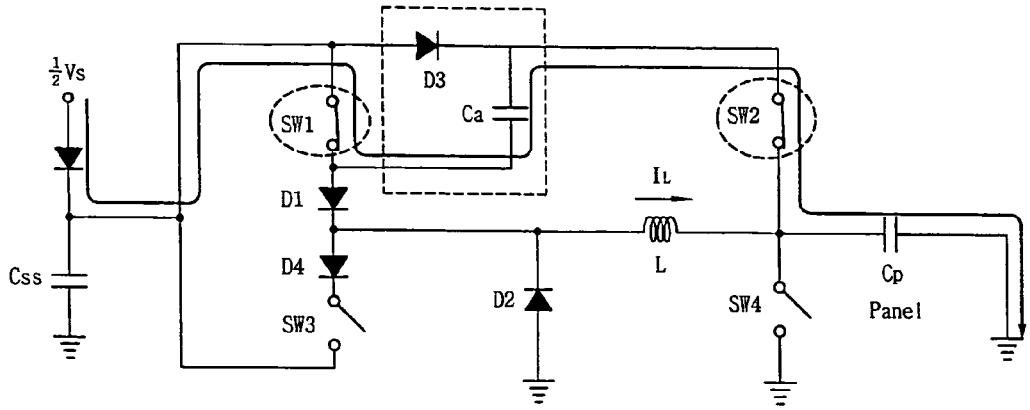
FIG. 8 is a circuit diagram of the energy recovery circuit of FIG. 3 during operation in an interval t3.

FIG. 8 is a circuit diagram of the energy recovery circuit of FIG. 3 during operation in an interval t3. During the interval t3, the first and second switches SW1 and SW2 are turned on and the third and fourth switches SW3 and SW4 are maintained in their off states. With the switches set in this manner, a closed loop is formed as shown in FIG. 8 passing through (in this sequence) the ½ sustain voltage source Vs/2, the first switch SW1, the auxiliary capacitor Ca, the second switch SW2, the panel capacitor Cp, then to the ground voltage source GND. As a result, a voltage of the ½ sustain voltage source Vs/2 is supplied to a first node n1 of the auxiliary capacitor Ca shown in FIG. 3. A voltage of a second node n2 of the auxiliary capacitor Ca becomes a sustain voltage Vs by the combination of the ½ sustain voltage Vs/2 of the first node n1 and the ½ sustain voltage Vs/2 charged to the auxiliary capacitor Ca during the interval t5. Therefore, a sustain voltage Vs is supplied to a drain terminal of the second switch SW2 such that the sustain voltage Vs is maintained in the panel capacitor Cp.

Figure 9:
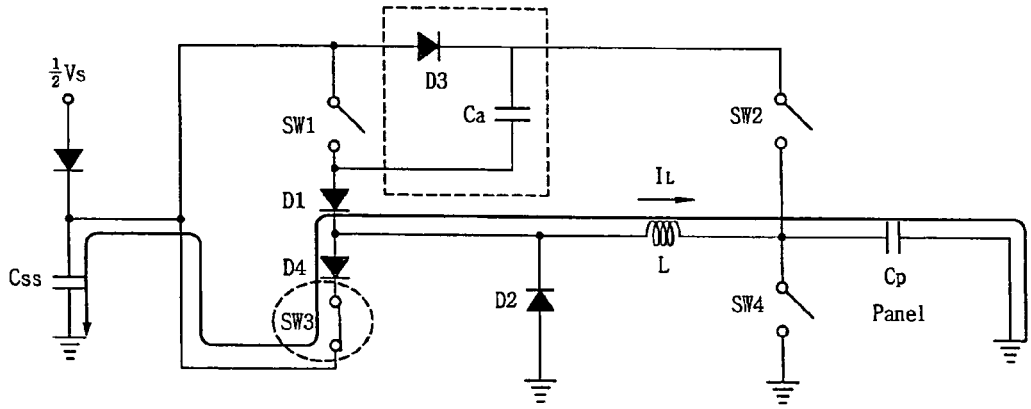
FIG. 9 is a circuit diagram of the energy recovery circuit of FIG. 3 during operation in an interval t4.

FIG. 9 is a circuit diagram of the energy recovery circuit of FIG. 3 during operation in an interval t4 of FIG. 4. During the interval t4, the, third switch SW3 is turned on, the first and second switches SW1 and SW2 are turned off, and the fourth switch SW4 is maintained in its off state. With the switches set in this manner, a closed loop is formed as shown in FIG. 9 passing through (in this sequence) the panel capacitor Cp the inductor L, the fourth diode D4, the third switch SW3, and the external capacitor Css that is used for energy recovery. The energy stored in the panel capacitor Cp is discharged to the energy recovery external capacitor Css by the resonance of the inductor L and the capacitor Cp. At this time, the fourth diode D4 acts in this closed loop as a current path of the inductor L.

In the interval t5, as described above, the fourth switch SW4 is turned on while the first, second, and third switches SW1, SW2, and SW3 are turned off such that the auxiliary capacitor Ca is charged with the ½ sustain voltage Vs/2 by the ½ sustain voltage source Vs/2, and the panel capacitor Cp maintains the ground voltage GND by the ground voltage source GND.

The following describes the operation of the energy recovery circuit of the present invention on the basis of means to perform the required operations.

As described above, the plasma display panel according to the present invention includes sustain means for providing energy to electrodes related to selected cells to effect discharge in the selected cells, and a panel capacitor, wherein the sustain means comprises: an inductor for charging for discharging the panel capacitor; inductor charge path means which provides a path through which energy is charged to the inductor and is opened when the inductor is substantially fully charged; panel capacitor charge path means which provides a path through which the panel capacitor is charged with the energy charged in the inductor and is opened when the panel capacitor is substantially fuller charged; panel capacitor discharge path means which provides a path through which the panel capacitor is discharged and is opened when the panel capacitor is substantially fully discharged; and auxiliary storage means which stores energy if the substantially fully discharged state of the panel capacitor is maintained and supplies the energy to the panel capacitor if the substantially fully charged state of the panel capacitor is maintained.

That is, the inductor charge path means refers to the closed loop indicated in FIG. 6, the panel capacitor charge path means refers to the closed loop indicated in FIG. 7, the panel capacitor discharge path means refers to the closed loop indicated in FIG. 9, and the auxiliary storage means refers to the multiple voltage circuit2 of FIG. 3.

Further, the sustain means according to the present invention has potential sustain means, which refers to the closed loop of FIG. 8 that maintains the panel capacitor Cp at the sustain voltage Vs, and to the second closed loop of FIG. 5 that maintains the panel capacitor Cp at ground voltage GND.

Since the operational characteristics of each of the means have already been described, a description thereof will be omitted.

A PDP drive method of the present invention drives the PDP through an inductor connected to panel electrodes in a PDP having a panel capacitor corresponding to the panel electrodes. The drive method includes a step of charging the panel capacitor through the inductor in which the charging of the panel capacitor starts when an inductor current is at a maximum, and is discontinued when the inductor current becomes zero. The drive method also includes a step of discharging the panel capacitor through the inductor firstly while energy is stored in the inductor until the inductor current first reaches a maximum, and secondly while energy stored in the inductor is removed until the inductor current reaches zero.

The above drive method is described with reference to the waveform of the panel capacitor voltage Vp add the waveform of the current IL flowing through the inductor shown in FIG. 4

With reference to FIG. 4, in the step of charging the panel capacitor, the panel capacitor voltage Vp starts to be increased from zero starting from when the current IL flowing through the inductor reaches a maximum, and the panel capacitor voltage Vp becomes the sustain voltage Vs when the current IL flowing through the inductor is reduced back to zero. That is, charging of the panel capacitor is realized through booster charging in which the panel capacitor is charged following when energy is maximally stored in the inductor.

Further, the step of discharging the panel capacitor is realized through natural resonance of the inductor L and the panel capacitor Cp as in the discharge step of the conventional energy recovery circuit.

In the present invention described above, the voltage of an external voltage source is reduced to one half of the sustain voltage Vs such that the energy consumed by the drive circuit is minimized. Also, energy is maximally stored in the inductor L before supplying the energy to the panel capacitor to thereby allow for booster charging. By using such a booster charging method, the rise time of the sustain pulse may be reduced.

INDUSTRIAL APPLICABILITY

As described above, the energy recovery circuit of the present invention reduces the voltage of an external voltage source to one half of the sustain voltage Vs such that the energy consumed by the drive circuit is minimized. In addition, by first maximally storing energy in the inductor L before supplying the energy to the panel capacitor, booster charging is realized. Also, as a result of using such a booster charging method, the rise time of the sustain pulse may be reduced.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

The invention claimed is:

1. A plasma display panel including sustain means for providing energy to electrodes related to selected cells to effect discharge in the selected cells, and a panel capacitor, wherein the sustain means comprises:

an inductor for charging or discharging the panel capacitor;

inductor charge path means which provides a path through which energy is charged to the inductor and is opened when the inductor is substantially fully charged;

panel capacitor charge path means which provides a path through which the panel capacitor is charged with the energy charged in the inductor and is opened when the panel capacitor is substantially fully charged;

panel capacitor discharge path means which provides a path through which the panel capacitor is discharged and is opened when the panel capacitor is substantially fully discharged;

auxiliary storage means which stores energy if the substantially fully discharged state of the panel capacitor is maintained and supplies the energy to the panel capacitor if the substantially fully charged state of the panel capacitor is maintained; and potential sustain means connected to the inductor and the panel capacitor, and performs selective driving during gas discharge of the panel, wherein the potential sustain means includes switch means connected between the auxiliary storage means and the panel capacitor, and another switch means connected between a ground potential and the panel capacitor.

2. The plasma display panel of claim 1, wherein the auxiliary storage means includes energy storage means and reverse flow preventing means for preventing the reverse flow of stored energy.

3. The plasma display panel of claim 2, wherein the energy storage means comprises a capacitor.

4. The plasma display panel of claim 2, wherein the reverse flow preventing comprises a diode.

5. The plasma display panel of claim 4, wherein the diode is forward biased until the capacitor is fully charged, and reverse biased after the capacitor is fully charged.

6. The plasma display panel of claim 1, wherein the inductor charge path means and the panel capacitor discharge path means each includes a metal oxide semiconductor field effect transistor (MOSFET).

7. The plasma display panel of claim 6, wherein the inductor charge path means and the panel capacitor discharge path means each further includes a diode.

8. The plasma display panel of claim 7, wherein the diode of the inductor charge path means is forward biased until the inductor is fully charged, and reverse biased after the inductor is fully charged to discontinue charging of the inductor.

9. The plasma display panel of claim 7, wherein the diode of the panel capacitor discharge path is forward biased until the panel capacitor is fully discharged, and reverse biased in response to the panel capacitor being fully discharged.

10. The plasma display panel of claim 1, wherein the panel capacitor charge means includes a diode.

11. The plasma display panel of claim 10, wherein the diode of the panel capacitor charge means is forward biased until the panel capacitor is fully charged, and reverse biased after the panel capacitor is fully charged to discontinue charging of the panel capacitor.

12. A method for driving a plasma display panel in which the plasma display panel is driven through an inductor connected to panel electrodes in the plasma display panel having a panel capacitor corresponding to the panel electrodes, the method comprising:

charging the panel capacitor through the inductor in which the charging of the panel capacitor starts when an inductor current is at a maximum, and is discontinued when the inductor current becomes zero; and discharging the panel capacitor through the inductor firstly while energy is stored in the inductor until the inductor current reaches a maximum, and secondly while energy stored in the inductor is removed until the inductor current reaches zero.

13. A plasma display panel including an energy recovery circuit which is connected to each scan electrode and sustain electrode, and supplies a sustain pulse having a sustain voltage alternately to a panel capacitor that is formed equivalently in the discharge cell of the panel, wherein the energy recovery circuit comprises:

an external ½ sustain voltage source having a voltage that is one half of the sustain voltage;

an external capacitor for recovering energy when energy stored in the panel capacitor is discharged;

an inductor for charging or discharging the panel capacitor;

a multiple voltage circuit including an auxiliary capacitor for generating the sustain voltage using the voltage of the ½ sustain voltage source;

a first switch turned on a first time such that energy is charged to an inductor, and turned on a second time such that the sustain voltage is supplied to the panel capacitor;

a second switch turned on at the same time the first switch is turned on for the second time such that the sustain voltage is supplied to the panel capacitor;

a third switch turned on such that energy stored in the panel capacitor is discharged to the external capacitor; and a fourth switch turned on such that a ground voltage is supplied to the panel capacitor and a ½ sustain voltage is charged to the auxiliary capacitor in the multiple voltage circuit.

14. The plasma display panel of claim 13, wherein the energy recovery circuit further comprises a first diode, an anode terminal of which is connected to the first switch and to one end of the multiple voltage circuit, and a cathode terminal of which is connected to one end of the inductor such that the flow of reverse current is prevented when the ½ sustain voltage is charged to an auxiliary capacitor and when energy is stored to the inductor.

15. The plasma display panel of claim 13, wherein the energy recovery circuit further comprises a second diode, an anode terminal of which is connected to a ground potential and a cathode terminal of which is connected to one end of the inductor such that the flow of reverse current is prevented when energy stored in the inductor is charged to the panel capacitor.

16. The plasma display panel of claim 13, wherein the energy recovery circuit further comprises a third diode, an anode terminal of which is connected to one end of the first switch and to the external ½ sustain voltage source, and a cathode terminal of which is connected to the auxiliary capacitor and to one end of the second switch such that the flow of reverse current is prevented when the sustain voltage is supplied to the panel capacitor through the multiple voltage circuit following substantially full charging of the panel capacitor.

17. The plasma display panel of claim 13, wherein the energy recovery circuit further comprises a fourth diode, an anode terminal of which is connected to one end of the inductor and a cathode terminal of which is connected to one end of the third switch such that the flow of reverse current is prevented when the panel capacitor discharges.

* * * * *